United States Patent [19]

Chammah

[11] 4,180,933

[45] Jan. 1, 1980

[54] ELECTRIC DICTIONARY

[76] Inventor: Georges A. Chammah, 100 Cote-Vertu, Apt. 1010, St. Laurent, Canada, P.Q. H4N1C7

[21] Appl. No.: 822,077

[22] Filed: Aug. 5, 1977

[51] Int. Cl.[2] ..... G09F 11/22

[52] U.S. Cl. ..... 40/471; 40/347; 40/385; 40/463

[58] Field of Search ..... 40/471, 518, 385, 341, 40/342, 347, 466, 467

[56] References Cited

U.S. PATENT DOCUMENTS

| | | | |
|---|---|---|---|
| 444,236 | 1/1891 | Rowe | 40/482 |
| 823,362 | 6/1906 | Powell et al. | 40/347 |
| 1,373,966 | 4/1921 | Keyser | 40/471 |
| 2,419,802 | 4/1947 | Van Horne | 40/471 |
| 2,650,097 | 8/1953 | Erdos | 40/471 X |
| 2,729,006 | 1/1956 | Olsson | 40/471 |
| 2,901,847 | 9/1959 | Lee | 40/471 |
| 3,062,097 | 11/1962 | Hutterer | 40/471 |
| 3,174,241 | 3/1965 | Rohan | 40/367 |
| 3,358,393 | 12/1967 | Lewis | 40/471 |
| 3,815,244 | 6/1974 | Hein | 40/471 |

FOREIGN PATENT DOCUMENTS

| | | | |
|---|---|---|---|
| 2202003 | 7/1973 | Fed. Rep. of Germany | 40/471 |
| 1405859 | 9/1975 | United Kingdom | 40/471 |

*Primary Examiner*—John F. Pitrelli
*Assistant Examiner*—G. Lee Skillington
*Attorney, Agent, or Firm*—Howard I. Podell

[57] ABSTRACT

A device for displaying the definition of words listed alphabetically in sequence on a continuous roll of tape. The tape is rolled past a display window between two rollers each linked by a belt to a reversible motor. A cursor is externally slidably mounted on the housing so as to travel under manual pressure transversely to the direction of travel of the tape, with an electrical contact brush internally mounted to the cursor above the tape which makes contact with a metal idler roller under the tape when the cursor is positioned so that the brush passes through a hole in the tape. A hole is located in the tape at the beginning of each set of words of each letter of the alphabet, with the transverse location of such holes corresponding to markings on the housing to which the cursor may be aligned.

3 Claims, 4 Drawing Figures

FIG.1
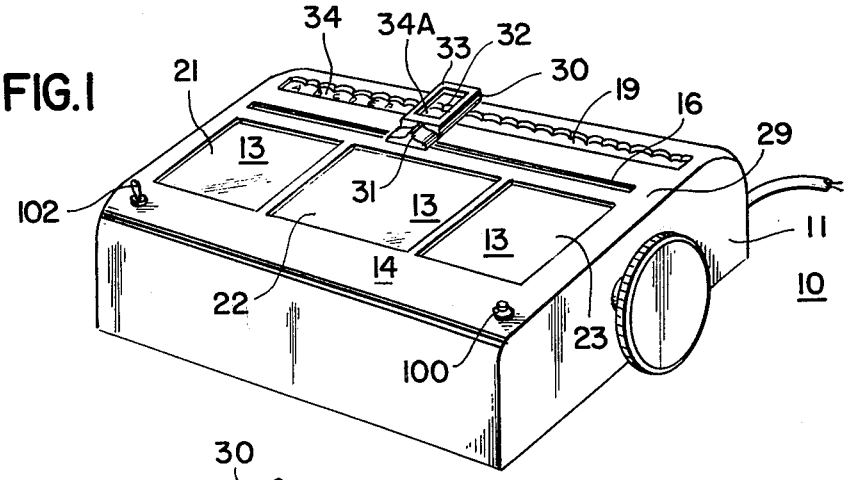
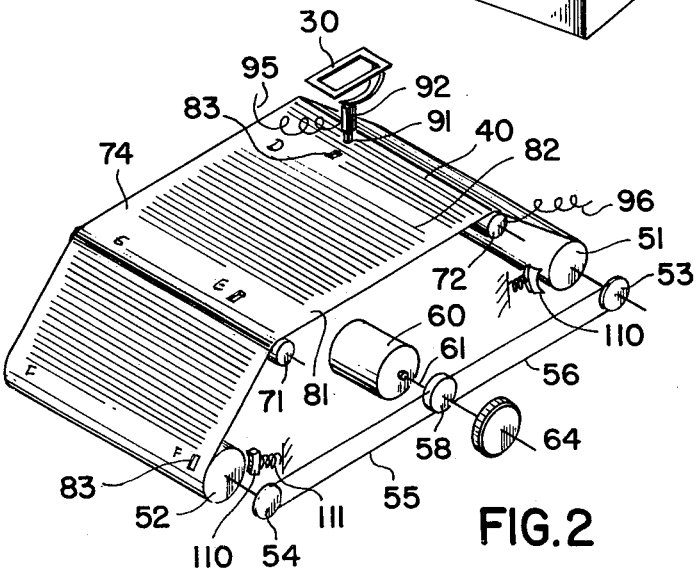
FIG.2
FI(
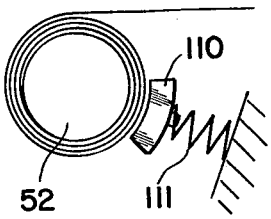
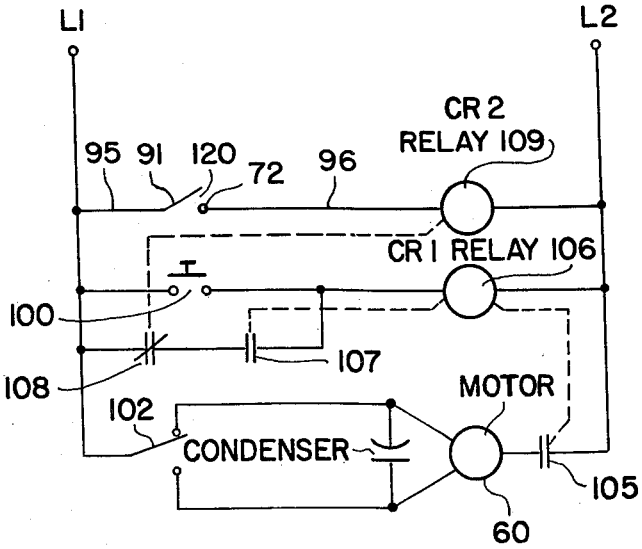
FIG.3

ELECTRIC DICTIONARY

SUMMARY OF THE INVENTION

My invention is a device for displaying the definition of words listed alphabetically in sequence on a continuous roll of tape. The tape is rolled past a display window between two rollers each linked by a belt to a reversible motor. A cursor is externally slidably mounted on the housing so as to travel under manual pressure transversely to the direction of travel of the tape, with an electrical contact brush internally mounted to the cursor above the tape which makes contact with a metal idler roller under the tape when the cursor is positioned so that the brush passes through a hole in the tape. A hole is located in the tape at the beginning of each set of words of each letter of the alphabet, with the transverse location of such holes corresponding to markings on the housing to which the cursor may be aligned.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention;

FIG. 2 is a perspective schematic view of the mechanism;

FIG. 3 is a schematic view of the electrical circuitry; and

FIG. 4 is a detail schematic view of a roller and brake unit.

DESCRIPTION OF THE PREFERRED EMBODIMENT

Turning now descriptively to the drawings, in which similar reference characters denote similar elements throughout the several views, FIG. 1 illustrates the device 10 which is enclosed in a housing 11, with window openings 21, 22 and 23 each covered by a glass panel 13 located in the top face 29 of the device. A cursor 30 is slidably mounted in transverse slot 16 that extends the width of the glass panel 13, with cursor 30 formed with an external finger grip projection 31 joined to a section frame 33 formed with a window section 32 that exposes indicia 34 marked externally along the width of face 19.

As shown in FIG. 2, a continuous length of tape 40 is wound at each end upon opposed parallel rollers 51, 52, with each said roller linked by a shaft to a pulley 53, 54 respectively, and with each pulley 53, 54 linked by an individual belt 55, 56 to a common pulley 58 mounted on the drive shaft 61 of reversible motor 60. Drive shaft 61 extends externally of the housing, with the external section of shaft 61 joined to a knob 64 so that pulley 58 may be manually rotated as desired.

Tape 40 passes over idler rollers 71, 72 which maintain a display section 74 of the tape in proximity to window opening 12.

The external face 81 of tape 40 is marked with words and their definitions arranged in alphabetical sequence of the said defined words along the length of the tape 40. At selected intervals a through hole 83 is located on tape 40 and positioned so that it corresponds in transverse orientation to the position of an indicia 34A displayed in cursor window section 32, with the particular displayed indicia 34A corresponding to the start of a particular section of alphabetic sequence of defined words displayed in glass panel 13, and with the normal tape direction of travel from roller 52 to roller 51.

An electrical contact brush 91 is fixed by a bracket 92 in the housing to the cursor through slot 16 and connected to a flexible wire 95, with brush 91 located to contact metal idler roller 72 only when the brush 91 extends through a hole 83 of the tape. Roller 72 is electrically connected to an electrical wire 96, with wires 95 and 96 connected to the electrical circuit of the device as shown in FIG. 3.

A momentary normally OFF switch 100 is mounted to the housing so that the switch push button extends externally of the housing, and a single pole double throw taggle switch 102 is similarly mounted to the housing.

As shown in FIG. 3, the direction of rotation of reversible motor 15 controlled by the position of toggle switch 102 with motor 60 in series with a normally open contact 105 of relay CRI.

The coil 106 of relay CRI is in series with momentary START/JOG switch 100. A relay holding circuit of normally open contact 107 of relay CRI in series with a normally closed contact 108 of relay CR2 is in parallel with switch 100. The coil 109 of relay CR2 is in series with the switch 120 formed by roller 72 and cursor contact 91 so that once switch 100 is momentarily actuated, motor 60 will wind tape 40 past window 12 until cursor contact 91 makes electrical contact through a hole 83 in tape 40 to stop the motor.

Since the cursor contact 91 is positively related to the position of the markings on tape 40 by holes 83, slippage of belts 55 and 56 about their respective pulleys does not affect the accuracy of the relation between the indicia 34 and the displayed data through window opening 12. A spring-biased brake 110 is mounted to bear against each roller 51, 52 to prevent excessive unwinding of a roller 52 when tape 40 is being wound upon roller 51, with both rollers driven by common pulley 58. Since each brake 110 bears against the tape wound upon the respective roller and since the brake spring 111 is in compression, the brake 110 bearing against a roller upon which less tape is wound may rotate at a faster rate to provide equal winding and unwinding of the tape upon both rollers, in use.

The three window openings 21, 22 and 23 are located to each expose a separate column of words and their definitions on the tape 40 with a first column of words and their definitions in alphabetical order of A to H displayed in window opening 21, a second column of words in alphabetical order of I to O, displayed in opening 22 and a third column of words in alphabetical order of P to Z displayed in window opening 23 as the tape is rolled past the window openings.

Alternately, start switch 100 and motor direction switch 102 may be mounted in conjunction with a slidable section of the cursor, such that sliding of the slidable section upwards starts the tape rolling upwards, with sliding of the slidable section downwards starts the tape rolling downwards.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An electrical dictionary comprising a tape on which the definitions of words are printed in the alphabetical sequence of the said words in a given direction along said tape, a housing in which each end of the tape is mounted on one of two spaced parallel wind-up rollers, said housing formed with a window opening in the exterior face of said housing through which the surface of the tape, on which the definitions are printed, is displayed for a section of the tape between said wind-up rollers, a cursor slidably mounted on the exterior face of said housing in a slot in the housing oriented perpendicular to the direction of travel of the tape, said cursor fitted to first electrical contact means in said housing, an idler roller, the surface of which is electrically conductive, mounted under the tape in a position to be contacted by said first electrical contact means when the first electrical contact means is not separated from the idler roller surface by a solid section of tape on said roller, between the said first electrical contact means and the idler roller, motorized means to drive said tape so as to wind upon a first wind up roller and unwind upon the second wind up roller, said motorized means of a reversible nature, with the direction thereof controlled by a reversing switch mounted to the housing, electrical circuitry means responsive to a start switch mounted on said housing which causes the motorized means to continuously rotate, once actuated by said start switch, and electrical means which causes said motorized means to stop responsive to electrical contact between the cursor first electrical contact means and the electrically conductive surface of the idler roller, with a plurality of indicia externally marked on the housing adjacent the path of travel of the cursor in the housing slot, and a plurality of holes in said tape, each of a size to permit the cursor first electrical contact means to electrically contact the idler roller surface, each of said tape holes been located along the lateral axis of the tape to correspond to a particular said indicia externally marked on the housing, with each said hole spaced along the axis of the path of travel of the tape to correspond to a definition of a word that is related to the position of the cursor with regard to a particular indicia.

2. The combination as recited in claim 1 in which brake means are applied against the exterior surface of of tape wound upon each wind-up roller, so as to apply brake torque against the tape in proportion to the diameter of tape wound upon the roller.

3. The combination as recited in claim 2 in which said brake means are biased by spring means, the force of which spring means is proportioned to the thickness of tape wound upon the associated wind-up roller.

* * * * *